US009356373B2

(12) United States Patent
Komoto et al.

(10) Patent No.: US 9,356,373 B2
(45) Date of Patent: May 31, 2016

(54) CONNECTOR FOR ELECTRICAL CONNECTION OF A PLATE-SHAPED OBJECT

(71) Applicant: JAPAN AVIATION ELECTRONICS INDUSTRY, LIMITED, Shibuyaku, Tokyo (JP)

(72) Inventors: Tetsuya Komoto, Tokyo (JP); Ryuzo Shimeno, Tokyo (JP)

(73) Assignee: JAPAN AVIATION ELECTRONICS INDUSTRY, LIMITED, Shibuyaku, Tokyo (JP)

( * ) Notice: Subject to any disclaimer, the term of this patent is extended or adjusted under 35 U.S.C. 154(b) by 114 days.

(21) Appl. No.: 14/272,418

(22) Filed: May 7, 2014

(65) Prior Publication Data

US 2014/0364017 A1 Dec. 11, 2014

(30) Foreign Application Priority Data

Jun. 11, 2013 (JP) ..... 2013-122340

(51) Int. Cl.

| | |
|---|---|
| ***H01R 12/24*** | (2006.01) |
| ***H01R 12/85*** | (2011.01) |
| ***H01R 12/77*** | (2011.01) |
| *H01R 12/79* | (2011.01) |

(52) U.S. Cl.

CPC ..... *H01R 12/85* (2013.01); *H01R 12/772* (2013.01); *H01R 12/79* (2013.01)

(58) Field of Classification Search

CPC ..... H05K 3/365; H01K 1/118; H01R 12/79; H01R 12/592; H01R 12/78; H01R 23/662

USPC ..... 439/67, 77, 492–497

See application file for complete search history.

(56) References Cited

U.S. PATENT DOCUMENTS

| | | | | |
|---|---|---|---|---|
| 3,492,538 | A * | 1/1970 | Fergusson | H01R 12/79 361/79 |
| 4,111,510 | A * | 9/1978 | Zurcher | G04G 17/06 439/493 |
| 4,348,071 | A * | 9/1982 | Hsieh | H01R 12/62 439/62 |
| 4,911,643 | A * | 3/1990 | Perry | H01R 4/01 439/493 |
| 4,938,702 | A * | 7/1990 | English | H01R 12/62 439/329 |
| 5,186,632 | A * | 2/1993 | Horton | H01R 12/62 439/493 |

(Continued)

FOREIGN PATENT DOCUMENTS

JP 2011-210484 A 10/2011

*Primary Examiner* — Thanh Tam Le

(74) *Attorney, Agent, or Firm* — Holtz, Holtz & Volek PC

(57) ABSTRACT

A connector which dispenses with an actuator and lowers profile while prevent damage to conducive path portions. A metal plate of the connector includes a first supporting portion mounted on a printed wiring board, and a second supporting portion connected to the first supporting portion via a linking portion in a manner movable in an FPC sandwiching direction. The second supporting portion includes a spring portion for urging a movable portion against FPC, a pair of locking pieces for increasing distance between contact point portions of the supporting portions by moving the movable portion away from the first supporting portion using an FPC inserting force, and suppressing removal of completely inserted FPC. Connection portions of conductive path portions are arranged on first and second protuberance portions at opposite ends of the first supporting portion in a connector left-right direction, along the connector front-back direction.

20 Claims, 22 Drawing Sheets

(56) References Cited

U.S. PATENT DOCUMENTS 6,881,085 B2 * 4/2005 Yahiro ..... H01R 12/721 439/326
7,238,032 B2 * 7/2007 Pabst ..... H01R 12/79 439/67
7,261,569 B2 * 8/2007 Uchida ..... H05K 3/365 439/492
7,435,101 B2 * 10/2008 Yoneta ..... H01R 13/2414 439/67
8,002,567 B2 * 8/2011 Hara ..... H01R 12/79 439/329
8,851,918 B2 * 10/2014 Yoshisuji ..... H01R 13/639 439/260
9,088,115 B2 * 7/2015 Komoto ..... H01R 12/774 439/493

* cited by examiner

CONNECTOR FOR ELECTRICAL CONNECTION OF A PLATE-SHAPED OBJECT

BACKGROUND OF THE INVENTION

1. Field of the Invention

This invention relates to a connector.

2. Description of the Related Art

Conventionally, as shown in FIGS. 19 to 22, there has been known a low-profile connector 1100 which comprises a connector main member 1200, an actuator 1300, and an electrode film 1400 (see Japanese Laid-Open Patent Publication (Kokai) No. 2011-210484 (paragraphs 0004, 0012 to 0021, FIGS. 1, 6 to 8, etc.). The connector 1100 is mounted on a circuit board, not shown.

The connector main member 1200 has, as shown in FIGS. 19 and 20, a base portion 1210 which is substantially in the form of a flat plate, two side wall portions 1220, a plurality of connection portions 1240, and a plurality of spring portions 1250. The connector main member 1200 is made of metal, and the base portion 1210, the side wall portions 1220, the connection portions 1240, and the spring portions 1250 are integrally formed. The two side wall portions 1220 are located at opposite ends of the base portion 1210 in an X direction (see FIG. 19). The spring portions 1250 each extend from the respective connection portions 1240 in a Y direction. The spring portions 1250 and the base portion 1210 are opposed to each other in a Z direction with a gap therebetween (see FIG. 20). Each spring portion 1250 has a first spring portion 1251, a second spring portion 1254, a linking portion 1253, a first protrusion 1252, a second protrusion 1255, and an operation-receiving portion 1256. The first protrusion 1252 and the second protrusion 1255 each protrude toward the base portion 1210.

The actuator 1300 is a plate-like member, and as shown in FIG. 19, includes pivot shafts 1320 and cam portions 1330. The pivot shafts 1320 are located at opposite ends of the actuator 1300 in the X direction, and are rotatably supported by associated bearing portions 1230 formed in the side wall portions 1220 of the connector main member 1200. The cam portions 1330 has holes formed through the actuator 1300, and are configured such that when the actuator 1300 is rotated about the pivot shafts 1320 from a closed position (see FIG. 20) to an open position (see FIG. 21), the cam portions 1330 push up the operation-receiving portions 1256 of the spring portions 1250, respectively.

The electrode film 1400 comprises an insulator film 1410 and an electrode pattern 1420 formed on one surface of the insulator film 1410 (see FIG. 19). The other surface of the insulator film 1410 (surface on which the electrode pattern 1420 is not formed) is fixed to the connector main member 1200. The electrode film 1400 extends, as shown in FIG. 20, from a surface of each spring portion 1250 opposed to the base portion 1210, via an inner surface of the connection portion 1240, a surface of the base portion 1210 opposed to the spring portion 1250, and the other end 1212 of the base portion 1210, to a back surface of the base portion 1210 (surface on an opposite side of the surface opposed to the spring portion 1250). The electrode film 1400 is substantially S-shaped when the connector 1100 is viewed from the X direction.

When the actuator 1300 is rotated from the closed position (see FIG. 20) to the open position (see FIG. 21), the operation-receiving portion 1256 enters the cam portion 1330, and the operation-receiving portion 1256 is pushed up by an inner peripheral surface of the cam portion 1330, whereby the whole spring portion 1250 is moved away from the base portion 1210. As a result, the gap between the first protrusion 1252 and the second protrusion 1255, and the base portion 1210 is made wider than the thickness of a plate-shaped object to be connected 1500, which makes it possible to insert the object to be connected 1500 easily between the spring portions 1250 and the base portion 1210.

After inserting the object to be connected 1500 between the spring portions 1250 and the base portion 1210, when the actuator 1300 is rotated from the open position to the closed position, each operation-receiving portion 1256 is disengaged from the associated cam portion 1330 (see FIG. 22), whereby the whole spring portion 1250 comes closer to the base portion 1210 so that the first protrusion 1252 and the second protrusion 1255 are urged against the object to be connected 1500 via the electrode film 1400. As a result, the electrode pattern 1420 of the electrode film 1400 is urged against electrodes (not shown) of the object to be connected 1500 to electrically connect between the object to be connected 1500 and a circuit board, not shown, (circuit board on which the connector 1100 is mounted).

In the low-profile connector 1100 described above, the electrode film 1400 fixed to the connector main member 1200 extends, as described above, from the surface of each spring portion 1250 opposed to the base portion 1210, via the inner surface of the connection portion 1240, the surface of the base portion 1210 opposed to the spring portion 1250, and the other end 1212 of the base portion 1210, to the back surface of the base portion 1210, and the electrode film 1400 sharply folds back around the other end 1212 of the base portion 1210 (see FIG. 20). Therefore, there is a problem that the electrode pattern 1420 of the electrode film 1400 is prone to damage.

Further, the connector 1100 includes, as components thereof, not only the connector main member 1200 and the electrode film 1400 fixed thereto, but also the actuator 1300 as a separate component from the connector main member 1200, and this is a factor increasing the manufacturing costs of the connector.

SUMMARY OF THE INVENTION

The present invention has been made in view of these circumstances, and an object thereof is to provide a connector which dispenses with an actuator and is made lower in profile while preventing conductive path portions from being damaged.

To attain the above object, the present invention provides a connector that electrically connects a plate-shaped object to be connected and an other object to be connected to each other, comprising a metal plate for supporting the plate-shaped object to be connected in a sandwiching manner, the metal plate including a first supporting portion mounted on the other object to be connected, and a second supporting portion linked to the first supporting portion via a linking portion in a manner movable in a direction of sandwiching the plate-shaped object to be connected, the second supporting portion including a movable portion opposed to the first supporting portion, a spring portion for causing the movable portion to be urged against the plate-shaped object to be connected when the plate-shaped object to be connected is inserted between the first supporting portion and the movable portion, and a force application portion for causing the movable portion to move in a direction away from the first supporting portion to thereby increase a distance between the first supporting portion and the movable portion, when the plate-shaped object to be connected is inserted between the first supporting portion and the movable portion against a returning force of the spring portion, and for allowing the movable portion to move in a direction of approaching the first supporting portion by the returning force of the spring portion, when insertion of the plate-shaped object to be connected is completed, and a plurality of conductive path portions formed on the metal plate with an insulating layer provided therebetween, the plurality of conductive path portions respectively including contact point portions for being brought into contact with terminal portions of the plate-shaped object to be connected which is inserted between the first supporting portion and the movable portion, and connection portions for being connected to the other object to be connected, wherein at least one of the first supporting portion and the second supporting portion has a protruding portion formed thereon for pressing the contact point portions against the plate-shaped object to be connected which is inserted between the first supporting portion and the movable portion, wherein the contact point portions are arranged along an orthogonal direction to both of the direction of sandwiching the plate-shaped object to be connected and a connector front-back direction, and wherein the first supporting portion includes a first supporting portion body that is opposed to the second supporting portion in the direction of sandwiching the plate-shaped object to be connected, and is disposed on the other object to be connected, and a protuberance portion provided on the first supporting body and protruding outward of the force application portion in the orthogonal direction, and the connection portions are arranged on the protuberance portion along the connector front-back direction.

Preferably, the protuberance portion is provided as protuberance portions at respective opposite ends of the first supporting portion body in the orthogonal direction, wherein the connection portions of some of the plurality of conductive path portions are arranged on one of the protuberance portions along the connector front-back direction, and the connection portions of the rest of the plurality of conductive path portions are arranged on the other of the protuberance portions along the connector front-back direction.

Preferably, the force application portion is located forward of the protruding portion in the connector front-back direction.

Preferably, the protuberance portion is bent into a hollow cylindrical shape such that the connection portions are brought into contact with the other plate-shaped object to be connected.

Preferably, the conductive path portions are covered with an insulating layer, at locations of part of a surface of the first supporting portion body opposed to the second supporting portion, the part being located forward of the protruding portion in the connector front-back direction.

More preferably, the insulating layer covers the conductive path portions also at locations of a side surface of the protuberance portion toward the first supporting portion body.

Preferably, the first supporting portion includes positioning portions provided at a front end of the first supporting portion body in the connector front-back direction, for suppressing displacement of the plate-shaped object to be connected in both of the direction of sandwiching the plate-shaped object to be connected and the orthogonal direction.

Preferably, the second supporting portion includes a locking portion for maintaining a state in which insertion of the plate-shaped object to be connected has been completed.

More preferably, the locking portion also serves as the force application portion.

Preferably, the protruding portion is formed on each of the first supporting portion and the second supporting portion, and the protruding portion formed on the first supporting portion and the protruding portion formed on the second supporting portion are opposed to each other in the direction of sandwiching the plate-shaped object to be connected.

Preferably, the first supporting portion, the second supporting portion, and the linking portion are integrally formed with each other.

According to the present invention, it is possible to provide a connector which dispenses with an actuator and is made lower in profile while preventing conductive path portions from being damaged.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

First, a description will be given of a connector 1 according to an embodiment of the present invention, with reference to FIGS. 1 to 9.

Figure 6:
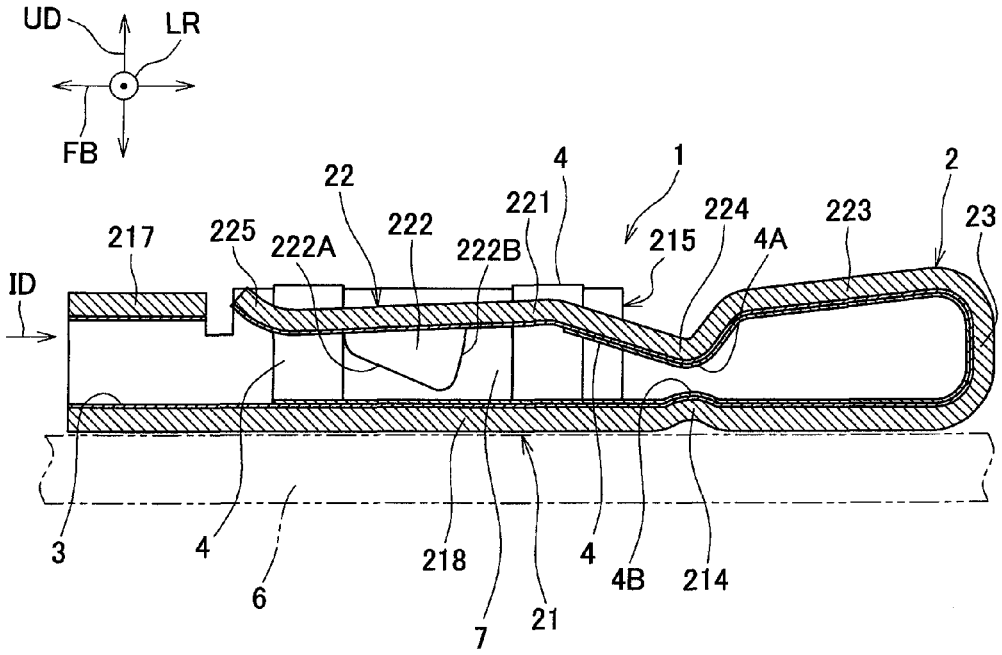
FIG. 6 is a cross-sectional view taken along VI-VI in FIG. 2.
Figure 8:
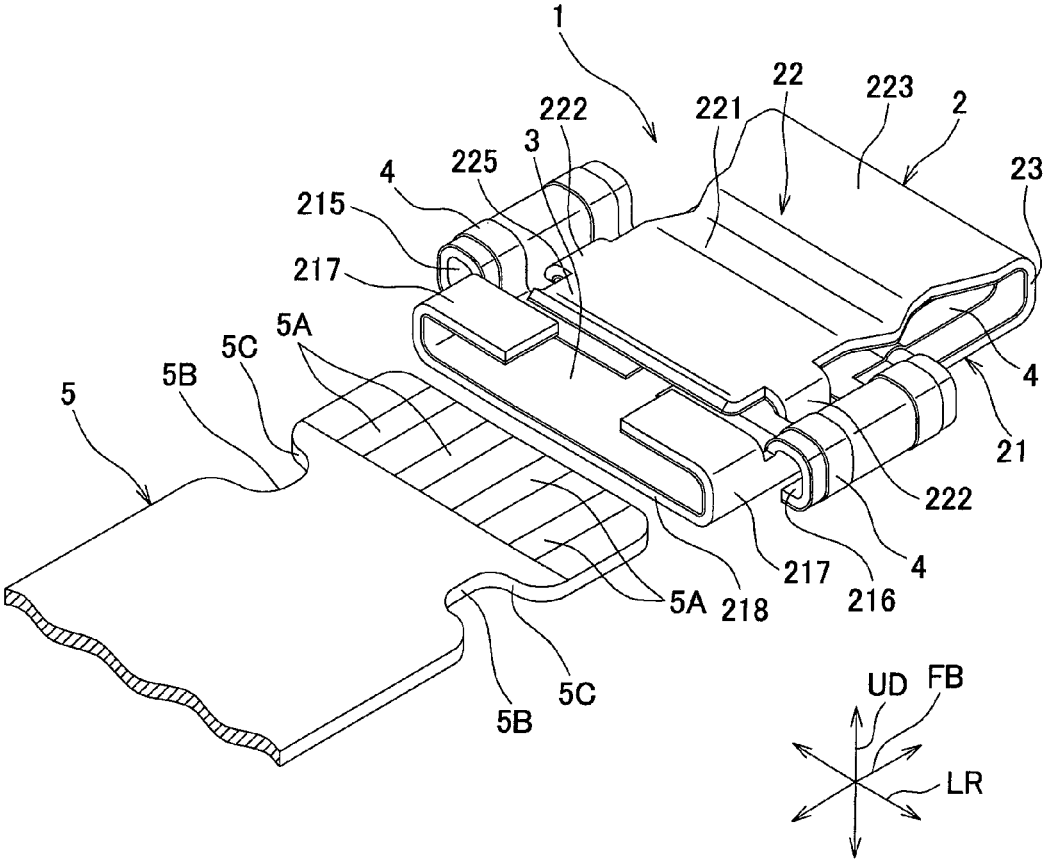
FIG. 8 is a perspective view of the connector shown in FIG. 1 and an FPC in a state before the FPC is inserted into the connector.
Figure 9:
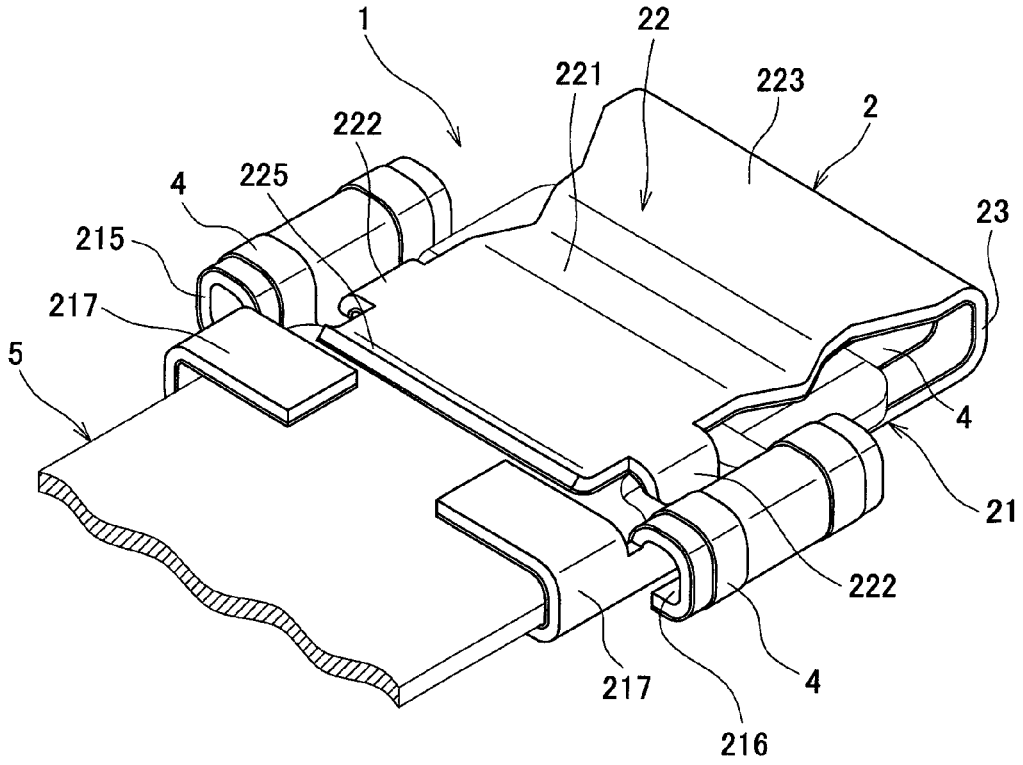
FIG. 9 is a perspective view of the connector shown in FIG. 1 and the FPC in a state after the FPC has been inserted into the connector.

As shown in FIGS. 6, 8, and 9, the connector 1 is used for electrically connecting between an FPC (Flexible Printed Circuit) 5, which is an example of a plate-shaped object to be connected, and a printed wiring board (the other object to be connected) 6.

Figure 1:
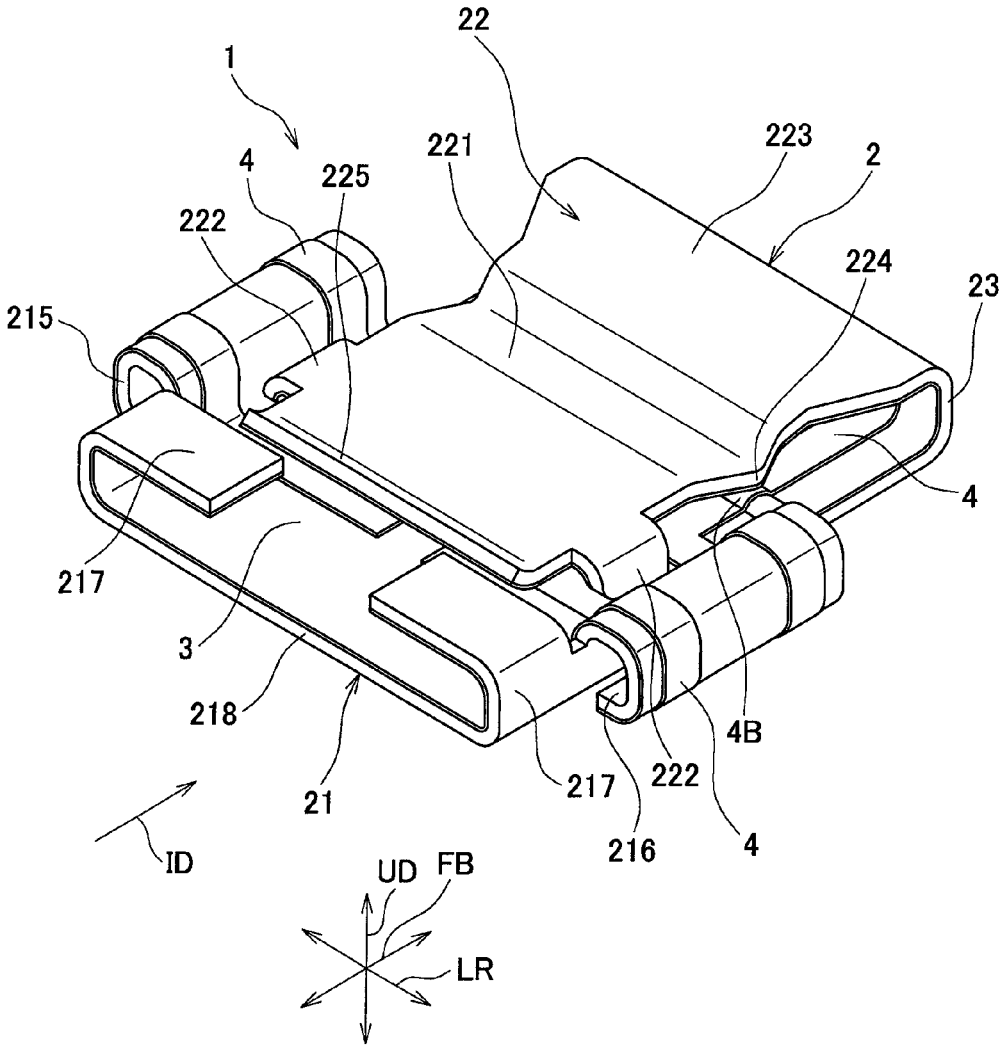
FIG. 1 is a perspective view of a connector according to an embodiment of the present invention.
Figure 5:
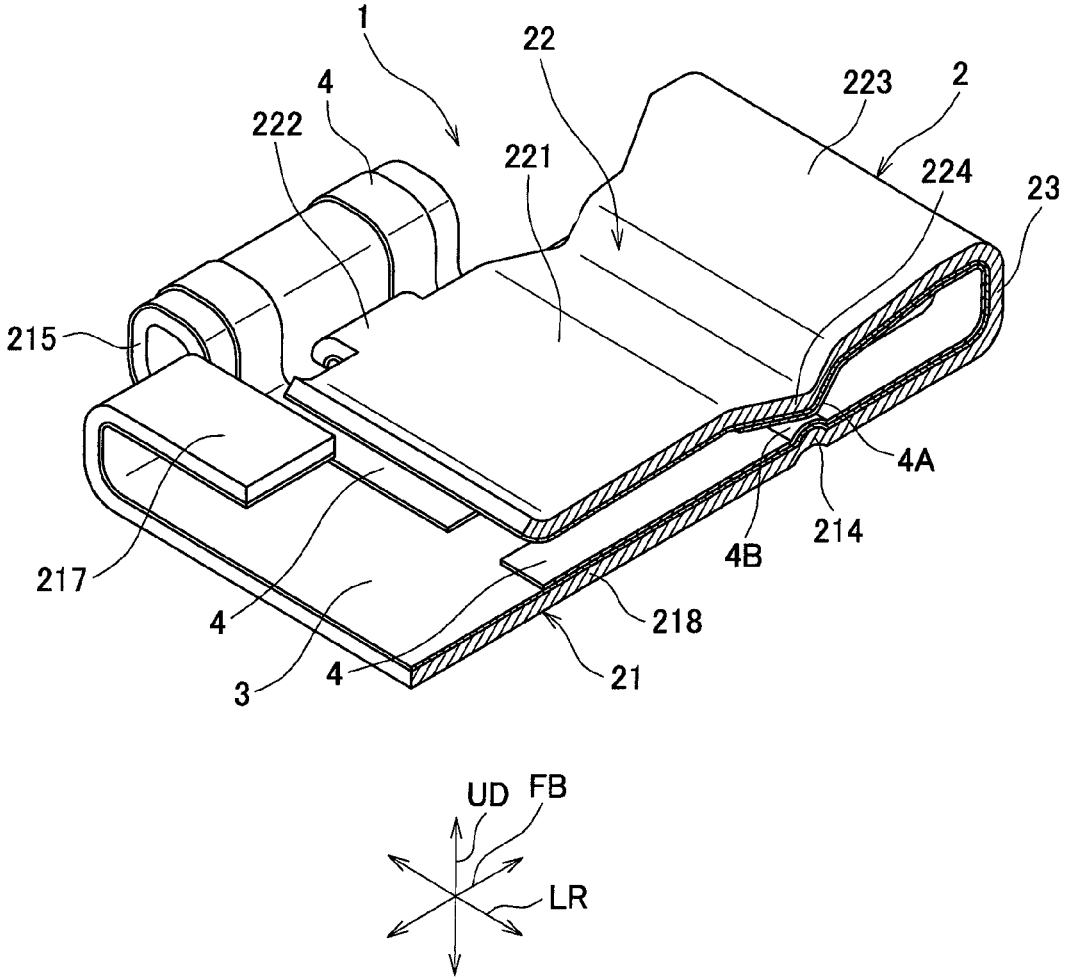
FIG. 5 is a perspective view of the connector shown in FIG. 1 in a state cut along V-V in FIG. 2.
Figure 7:
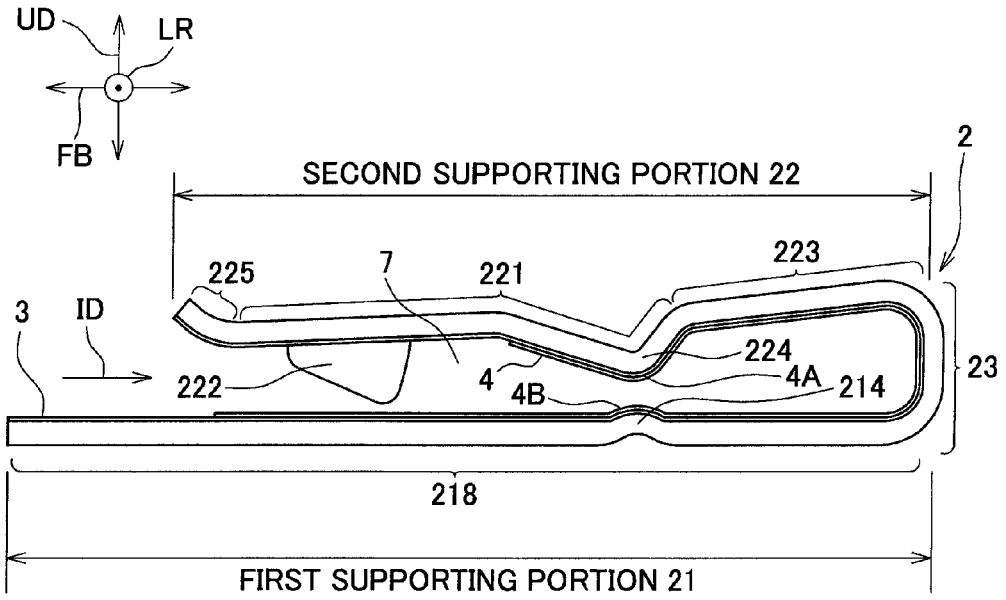
FIG. 7 is a concept diagram of the connector shown in FIG. 1.

As shown in FIGS. 1 and 5, the connector 1 comprises a metal plate 2 that supports the FPC 5 (see FIG. 8) in a sandwiching manner, and a plurality of conductive path portions 4 formed on the metal plate 2 with an insulating layer 3 provided therebetween. As shown in FIGS. 6 and 7, the metal plate 2 includes a first supporting portion 21 mounted on the printed wiring board 6, and a second supporting portion 22 linked to the first supporting portion 21 via a linking portion 23 in a manner movable in a direction UD of sandwiching the FPC 5 (vertical direction of the connector 1). In FIGS. 6 and 7, a left side is a front side of the connector 1, a right side is a back side of the same, an upper side is an upper side of the same, and a lower side is a lower side of the same. Further, FIG. 7 is a concept diagram illustrating the respective ranges of the first supporting portion 21, the second supporting portion 22, and the linking portion 23, which form the metal plate 2 shown in FIG. 6. In FIG. 7, for convenience of explanation, hatching is omitted and also illustration of a first protuberance portion 215 and a positioning portion 217 are omitted. An accommodation space 7 for accommodating the FPC 5 is formed between the first supporting portion 21 and the second supporting portion 22.

As shown in FIGS. 1, 6 and 7, the metal plate 2 is U-shaped, as viewed from a connector left-right direction LR (direction orthogonal to both of the direction UD of sandwiching the FPC (plate-shaped object to be connected) 5 and a connector front-back direction FB).

The first supporting portion 21 includes a first supporting portion body 218 which is opposed to the second supporting portion 22 in the direction UD of sandwiching the FPC 5, the first protuberance portion 215 provided at one end of the first supporting portion body 218 in the connector left-right direction LR, a second protuberance portion 216 provided at the other end of the first supporting portion body 218 in the connector left-right direction LR, a protruding portion 214 which urges contact point portions 4B of the conductive path portions 4, referred to hereinafter, against the FPC 5 inserted into the accommodation space 7, and a pair of positioning portions 217 which suppress displacement of the FPC 5 inserted into the accommodation space 7 (displacement of the FPC 5 both in the connector left-right direction LR and the direction UD of sandwiching the FPC 5).

Holes 218A for avoiding interference between the first supporting portion body 218 and locking pieces 222, described hereinafter, are formed in the opposite ends of the first supporting portion body 218 in the connector left-right direction LR (see FIGS. 3 and 4).

Figure 2:
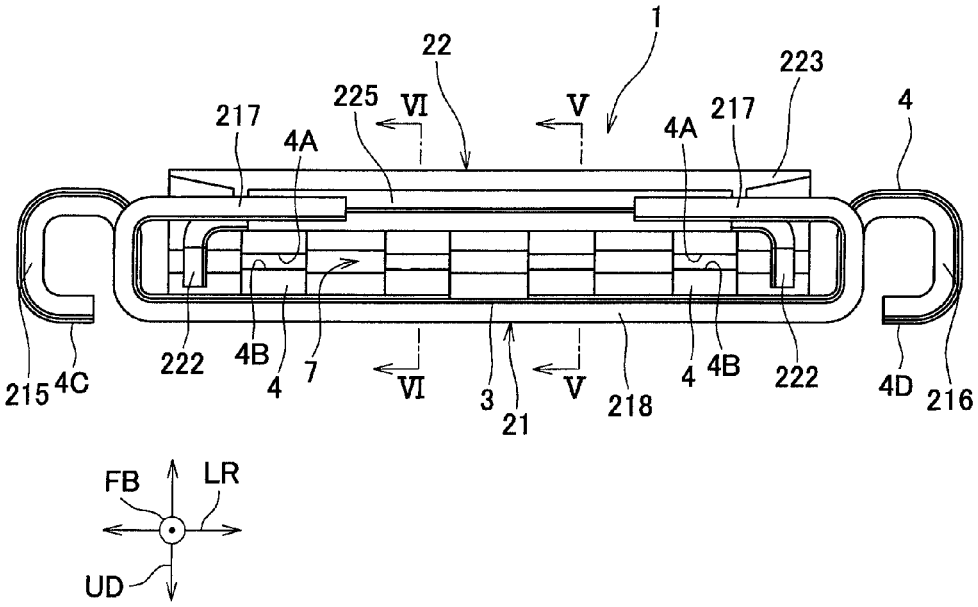
FIG. 2 is a front view of the connector shown in FIG. 1.
Figure 3:
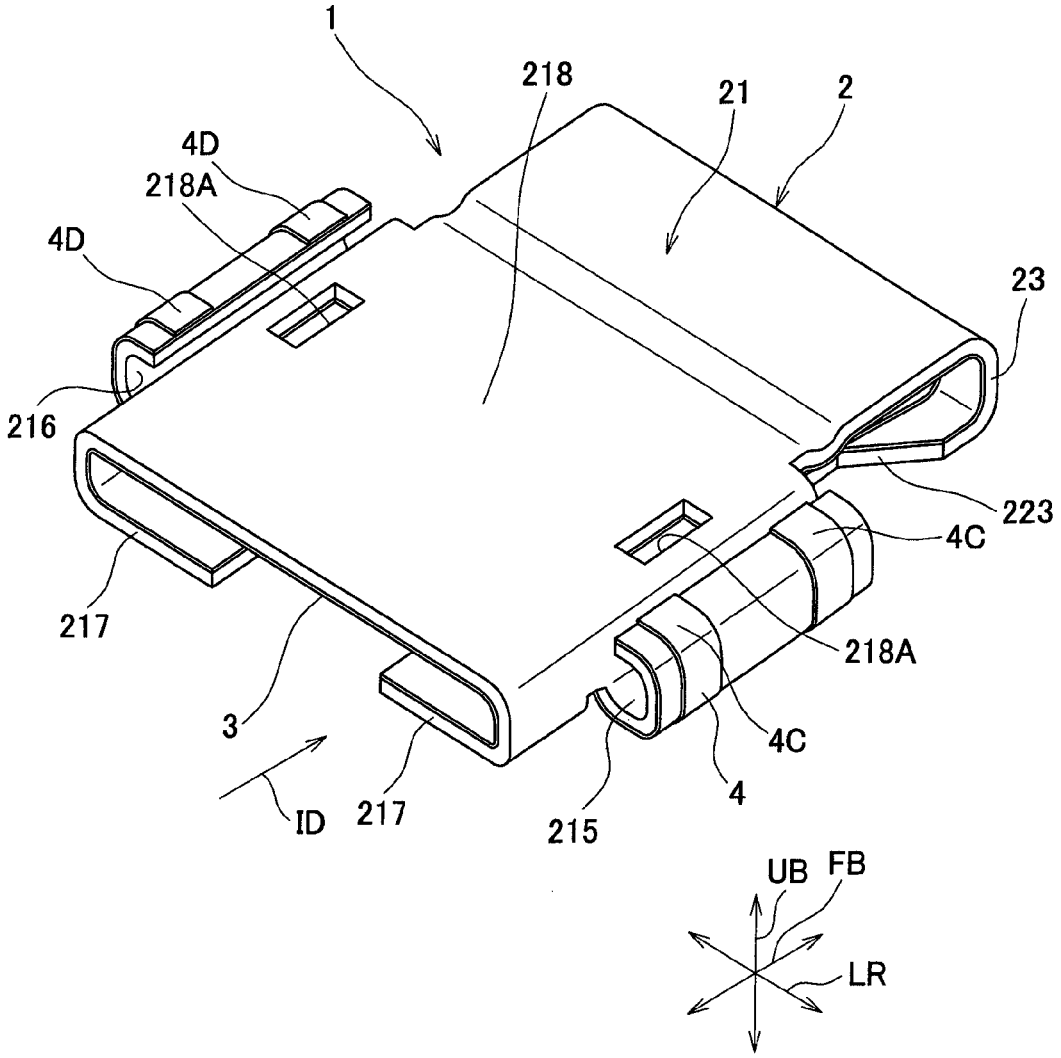
FIG. 3 is a perspective view of the connector shown in FIG. 1, as viewed obliquely from below.

As shown in FIGS. 1 to 3, the first protuberance portion 215 and the second protuberance portion 216 are both bent in a manner forming a hollow cylinder, such that connection portions 4C and 4D of the conductive path portions 4 are brought into contact with the printed wiring board 6. However, the cross-section of each of both the first and second protuberance portions 215 and 216 is not in the form of a closed loop but in the form of an open loop. Further, both the protruding portions 215 and 216 are located outward of the locking pieces 222 in the connector left-right direction LR. Further, the connection portions 4C located on the lower surface of the first protuberance portion 215 and the connection portions 4D located on the lower surface of the second protuberance portion 216 are each at substantially the same location as the lower surface of the first supporting portion body 218 of the first supporting portion 21 in the vertical direction of the connector 1.

As shown in FIG. 2, an upper end of the first protuberance portion 215 and an upper end of the second protuberance portion 216 are both located lower than an upper end of the second supporting portion 22 in the vertical direction of the connector 1.

Figure 4:
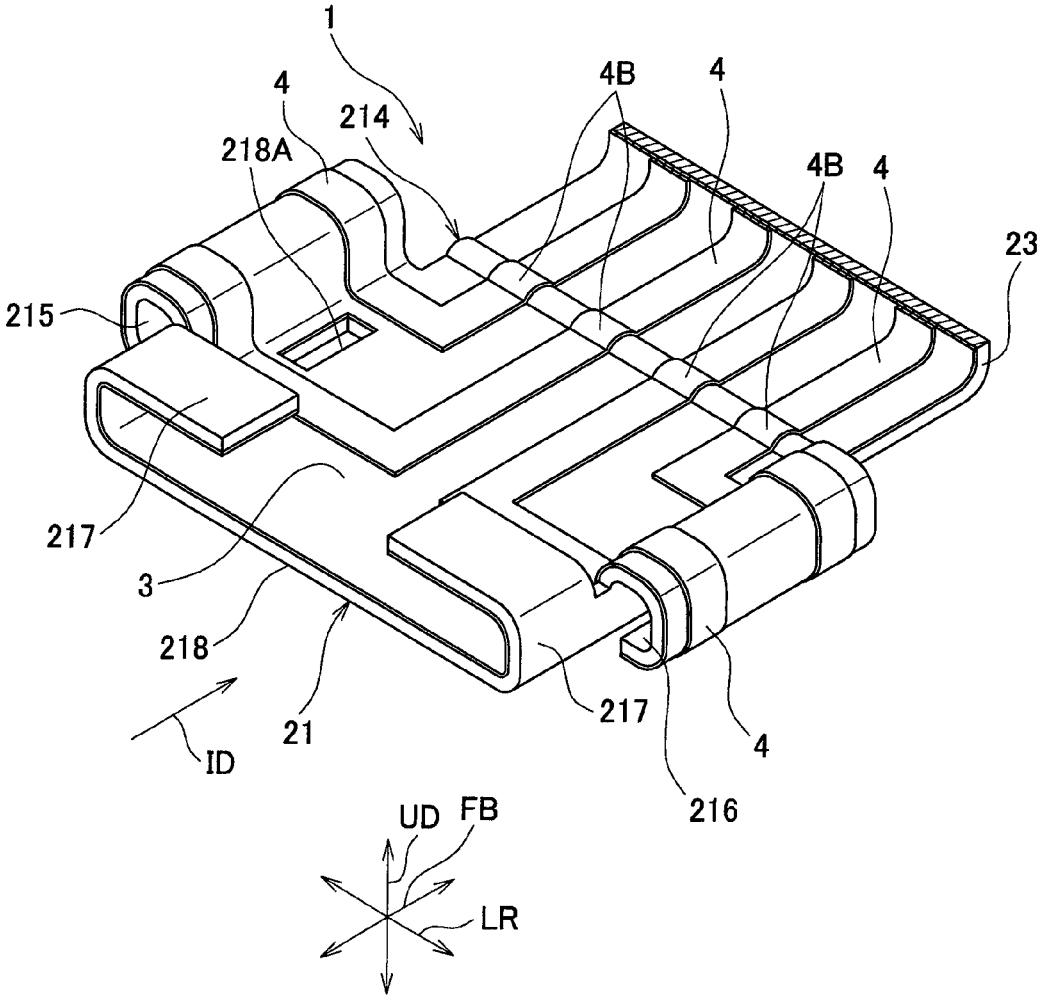
FIG. 4 is a perspective view of the connector shown in FIG. 1 in a state in which an upper part of a metal plate thereof is cut off.

As shown in FIG. 4, length of the first protuberance portion 215 and length of the second protuberance portion 216 in the connector front-rear direction FB are both longer than half of the width of the first supporting portion body 218 in the connector left-right direction LR.

As shown in FIGS. 1 and 2, the pair of positioning portions 217 are provided at a front end of the first supporting portion body 218 in the connector front-back direction FB. Each positioning portion 217 is bent into an L shape. The positioning portions 217 are located forward of the first protuberance portion 215 and the second protuberance portion 216 in the connector front-back direction FB, and are also located forward of a guiding portion 225 of the second supporting portion 22.

As shown in FIGS. 6 and 7, the second supporting portion 22 includes a movable portion 221 which is opposed to the first supporting portion body 218 of the first supporting portion 21 in the direction UD of sandwiching the FPC 5, the locking pieces 222 forming a pair (each serving as a force application portion and also as a locking portion), which receive an insertion force of the FPC 5 inserted into the accommodation space 7 and thereby cause the movable portion 221 to move in a direction away from the first supporting portion 21, and also prevent the FPC 5 completely inserted into the accommodation space 7 from being removed, a spring portion 223 which causes the movable portion 221 to be urged against the FPC 5 when the FPC 5 has been inserted into the accommodation space 7, a protruding portion 224 which presses contact point portions 4A of the conductive path portions 4 against the FPC 5 inserted into the accommodation space 7, and the guiding portion 225 which guides the FPC 5 into the accommodation space 7.

When the FPC 5 is inserted into the accommodation space 7, the pair of locking pieces 222 cause the movable portion 221 to move in the direction away from the first supporting portion body 218 of the first supporting portion 21 against the returning force of the spring portions 223 to increase a distance between the first supporting portion 21 and the movable portion 221, and when the insertion of the FPC 5 has been completed, the pair of locking pieces 222 enter cutouts 5B of the FPC 5, and the returning force of the spring portion 223 causes the movable portion 221 to move closer to the first supporting portion body 218 of the first supporting portion 21.

The pair of locking pieces 222 are provided at respective opposite ends of the movable portion 221 in the connector left-right direction LR. The locking pieces 222 are bent downward substantially at right angles to the movable portion 221 (see FIG. 2). The locking pieces 222 have a substantially right triangle shape as viewed from the connector left-right direction LR. An inclined surface 222A is formed on the front side of the locking piece 222 (front side in the connector front-back direction FB), and a stopper surface 222B is formed on the back side of the locking piece 222 (back side in the connector front-back direction FB). The inclined surface 222A obliquely intersects with an inserting direction ID of the FPC 5 and also faces obliquely downward. The stopper surface 222B is substantially orthogonal to the inserting direction ID of the FPC 5 such that the FPC 5 can be prevented from being removed. The stopper surfaces 222B prevent the FPC 5 from being removed by receiving a force in a direction in which the FPC 5 is removed (direction opposite to the inserting direction ID) to thereby function as a locking portion. As a consequence, a state in which the insertion of the FPC 5 has been completed is maintained.

The guiding portion 225 is located forward of the movable portion 221 (forward in the connector front-back direction FB).

As shown in FIGS. 5 to 7, the protruding portion 214 of the first supporting portion 21 and the protruding portion 224 of the second supporting portion 22 are opposed to each other in the direction UD of sandwiching the FPC 5, and the contact point portions 4B of the first supporting portion 21 and the contact point portions 4A of the second supporting portion 22 are opposed to each other in the direction UD of sandwiching the FPC 5.

The locking pieces 222 are located forward of the movable portion 221 (forward in the connector front-back direction FB), and the contact point portions 4A and 4B are located backward of the movable portion 221 (backward in the connector front-back direction FB). The locking pieces 222 are arranged at locations farther from the linking portion 23 than the contact point portions 4A and 4B are. Therefore, the small insertion force of the FPC 5 can move the locking pieces 222 upward.

As shown in FIG. 6, the plurality of conductive path portions 4 are formed on the metal plate 2 with the insulating layer 3 provided therebetween. Some of the plurality of conductive path portions 4 extend from the lower surface of the movable portion 221 of the second supporting portion 22, passing the inner surface of the linking portion 23 to reach the upper surface of the first supporting portion body 218, thereby extending beyond the protruding portion 214. As shown in FIG. 4, some of the plurality of the conductive path portions 4 extending beyond the protruding portion 214 extend to the first protuberance portion 215 and reach the lower surface of the first protuberance portion 215 (see FIGS. 2 and 3), and the rest of the plurality of the conductive path portions 4 extending beyond the protruding portion 214 extend to the second protuberance portion 216 and reach the lower surface of the second protuberance portion 216 (see FIGS. 2 and 3). Each conductive path portion 4 includes the contact point portions 4A and 4B which are brought into contact with terminal portions 5A formed on the opposite surfaces of the FPC 5 (only terminal portions 5A formed on one surface of the FPC 5 are shown in FIG. 8) which is inserted between the first supporting portion body 218 of the first supporting portion 21 and the movable portion 221, and the connection portion 4C or 4D which is soldered to a pad (not shown) on the printed wiring board 6. The contact point portion 4A is part of the conductive path portion 4 which covers the protruding portion 214 with the insulating layer 3 provided therebetween, and the contact point portion 4B is part of the conductive path portion 4 which covers the protruding portion 214 with the insulating layer 3 provided therebetween. The contact point portions 4B on the side of the first supporting portion 21 are arranged along the connector left-right direction LR (see FIG. 4), and the contact point portions 4A on the side of the second supporting portion 22 are arranged along the connector left-right direction LR (see FIG. 2). The connection portions 4C are respective portions of the conductive path portions 4 located on the lower surface of the first protuberance portion 215, and the connection portions 4D are respective portions of the conductive path portions 4 located on the lower surface of the second protuberance portion 216. The connection portions 4C on the side of the first protuberance portion 215 are arranged along the connector front-back direction FB and the connection portions 4D on the side of the second protuberance portion 216 are arranged along the connector front-back direction FB (see FIG. 3).

Next, a description will be given of an example of a method of manufacturing the connector 1.

First, an insulating layer 3 is formed by applying a resin to one surface of a flat plate-shaped metal plate 2 having spring properties. Then, a copper thin film is laminated on the insulating layer 3, and then a conductive pattern (a plurality of conductive path portions 4) is formed by etching.

After the conductive path portions 4 have been formed on the insulating layer 3, the metal plate 2 is blanked into a predetermined shape.

Then, the first protuberance portion 215, the second protuberance portion 216, and the positioning portions 217 are formed on the metal plate 2 by bending the same.

Thereafter, the guiding portion 225, the locking pieces 222, and the protruding portions 214 and 224 are formed on the metal plate 2 by bending the same.

Finally, the whole metal plate 2 is bent into a U shape as shown in FIG. 1.

Next, a method of using the connector 1 will be described.

To electrically connect the FPC 5 to the connector 1 mounted on the printed wiring board 6, it is only required to insert the FPC 5 into the accommodation space 7 of the connector 1.

When the FPC 5 is inserted into the accommodation space 7 of the connector 1, first, a front end of the FPC 5 is brought into contact with the inclined surfaces 222A of the locking pieces 222 to push the inclined surfaces 222A, whereby the locking pieces 222 are gradually moved upward, which causes the movable portion 221 to move in the direction away from the first supporting portion body 218 of the first supporting portion 21.

When the FPC 5 is inserted into the accommodation space 7 of the connector 1, even if the front end of the FPC 5 is displaced with respect to an entrance of the accommodation space 7 in the direction UD of sandwiching the FPC 5 or the connector left-right direction LR, the displacement is suppressed by the positioning portions 217, and the front end of the FPC 5 is guided into the accommodation space 7 by the guiding portion 225.

Further, since the locking pieces 222 are arranged forward of the contact point portions 4A and 4B and are located toward a free end of the second supporting portion 22 (toward the front in the connector front-back direction FB) which is displaceable in the direction UD of sandwiching the FPC 5 using the linking portion 23 as a support, so that compared with a connector (not shown), which is configured to widen a gap between the contact point portions 4A and 4B by inserting the front end of the FPC 5 between the contact point portions 4A and 4B, the connector 1 can cause the movable portion 221 to move in the direction away from the first supporting portion body 218 of the first supporting portion 21 with a smaller insertion force of the FPC 5.

When the FPC 5 is inserted into the accommodation space 7, causing the locking pieces 222 to get on the FPC 5, the gap between the contact point portions 4A and 4B becomes larger than the thickness of the FPC 5, so that the user of the connector 1 can insert the FPC 5 between the contact point portions 4A and 4B with the small insertion force.

When the front end of the FPC 5 is completely inserted into the accommodation space 7, the locking pieces 222 enter the cutouts 5B of the FPC 5 by the returning force of the second spring portion 223 (see FIG. 8), whereby the movable portion 221 is moved toward the first supporting portion 21. As a consequence, the gap between the contact point portions 4A and 4B becomes smaller, and the FPC 5 is sandwiched between the contact point portions 4A and 4B, with predetermined contact forces generated between the FPC 5 and the contact point portion 4A and between the FPC 5 and the contact point portion 4B. The FPC 5 and the printed wiring board 6 are thus electrically connected to each other.

Further, when the front end of the FPC 5 has been completely inserted into the accommodation space 7 of the connector 1, the locking pieces 222 enter the cutouts 5B of the FPC 5, and therefore even when a force for pulling out the FPC 5 from the connector 1 is generated due to some cause, stopper portions 5C (see FIG. 8) of the FPC 5 are brought into abutment with stopper surfaces 222B of the locking pieces 222 (see FIG. 6), whereby the FPC 5 is prevented from being removed. This maintains the state of the FPC 5 in which insertion thereof has been completed.

According to the connector 1 of the present embodiment, it is possible to dispense with an actuator and thereby reduce the number of component parts, and hence it is possible to reduce manufacturing costs of the connector.

Further, since it is possible to electrically connect the FPC 5 to the connector 1 by one action of inserting the front end of the FPC 5 into the accommodation space 7 of the connector 1, the connector 1 is more excellent in operability than the connector 1100 including the actuator 1300 shown in FIGS. 19 to 22.

Furthermore, since the locking pieces 222 are arranged forward of the contact point portions 4A and 4B (the protruding portions 224 and 214) (forward in the connector front-back direction FB), it is possible to make the insertion force of the FPC 5 smaller than a connector (not shown) which is configured to widen the gap between the contact point portions 4A and 4B by pushing and inserting the front end of the FPC 5 between the contact point portions 4A and 4B.

Further, since the locking pieces 222 are pushed up by insertion of the FPC 5, causing the gap between the contact point portions 4A and 4B to be increased, no large contact forces are generated between the conductive path portions 4 and the terminal portions 5A of the FPC 5 when inserting the FPC 5 into the gap between the contact point portions 4A and 4B, which makes the conductive path portions 4 and the terminal portions 5A of the FPC 5 difficult to wear away.

Further, the first protuberance portion 215 and the second protuberance portion 216 are both bent into a hollow cylindrical shape (see FIG. 1), and both of them have a cross-sectional shape which is gently curved (see FIG. 2). Therefore, when the first protuberance portion 215 and the second protuberance portion 216 are formed by bending, the conductive path portions 4 extending from the first supporting portion body 218 of the first supporting portion 21 to the respective lower surfaces of the first protuberance portion 215 and the second protuberance portion 216 are difficult to be damaged.

Further, by making the length of the first protuberance portion 215 and that of the second protuberance portion 216 in the connector front-back direction FB larger than half of the width of the first supporting portion body 218 in the connector left-right direction LR, it is possible to make the arrangement pitch of the connection portions 4C and 4D larger than that of the contact point portions 4A and 4B. Note that in this case, the width of each conductive path portion 4 is fixed, and the number of the connection portions 4C on the first protuberance portion 215 and that of the connection portions 4D on the second protuberance portion 216 are equal.

Further, the metal plate 2 is bent into a U shape as viewed from the connector left-right direction LR. Therefore, compared with a connector (not shown) which bent into an S shape as viewed from the connector left-right direction LR, it is possible to lower the profile of the connector. Further, no conductive path portions 4 are formed on the lower surface of the first supporting portion body 218, and hence it is possible to make the connector lower in profile than the connector 1100 shown in FIGS. 19 to 22.

Next, a connector 101 according to a first variation of the present embodiment will be described with reference to FIGS. 10 to 12.

The same components as those of the connector according to the embodiment shown in FIG. 1 are denoted by the same reference numerals, and detailed description thereof is omitted. The following description will be given of only different components from those of the embodiment shown in FIG. 1.

Figure 10:
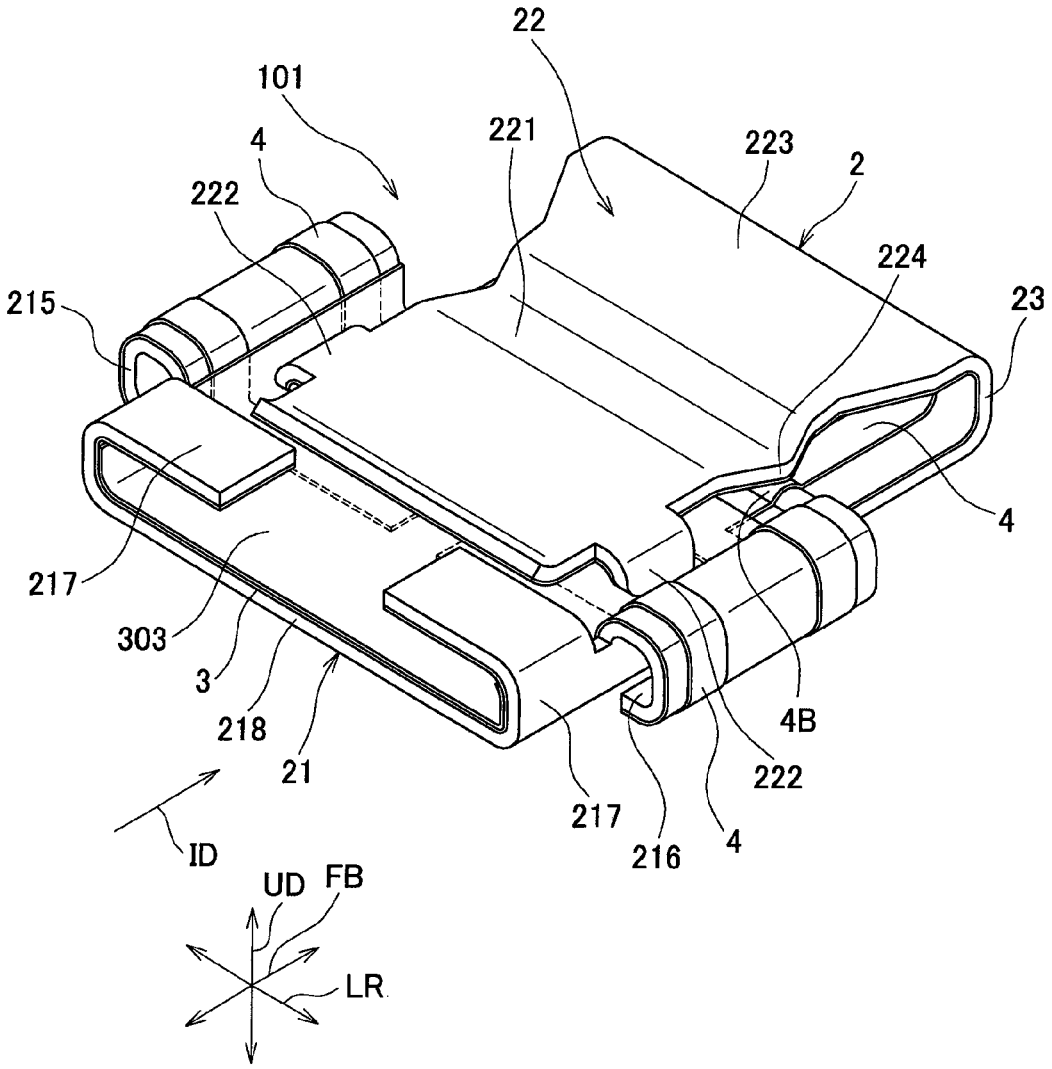
FIG. 10 is a perspective view of a connector according to a first variation of the embodiment.
Figure 11:
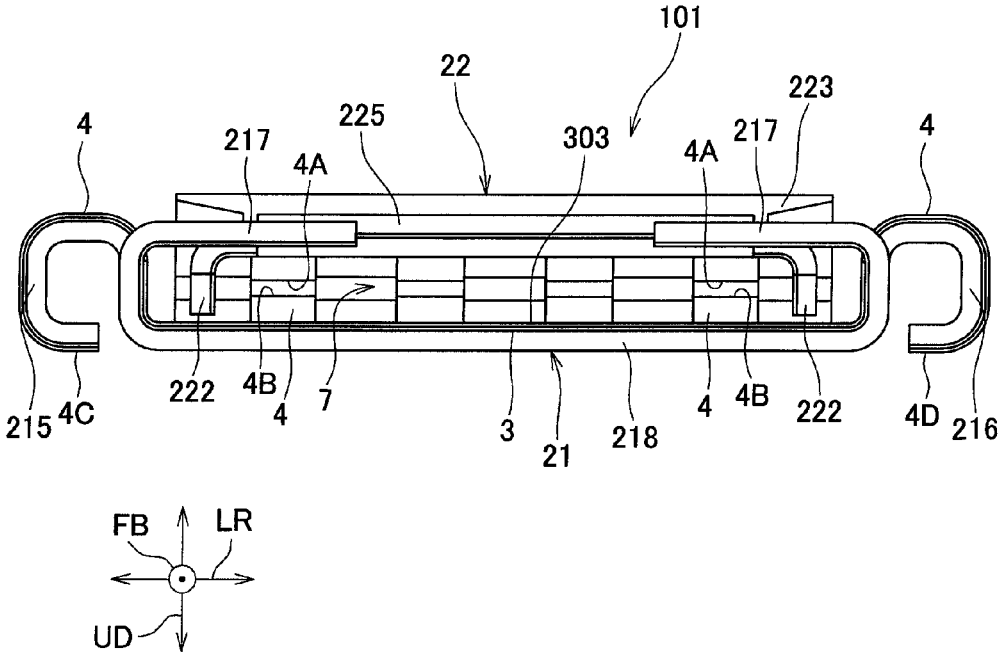
FIG. 11 is a front view of the connector shown in FIG. 10.
Figure 12:
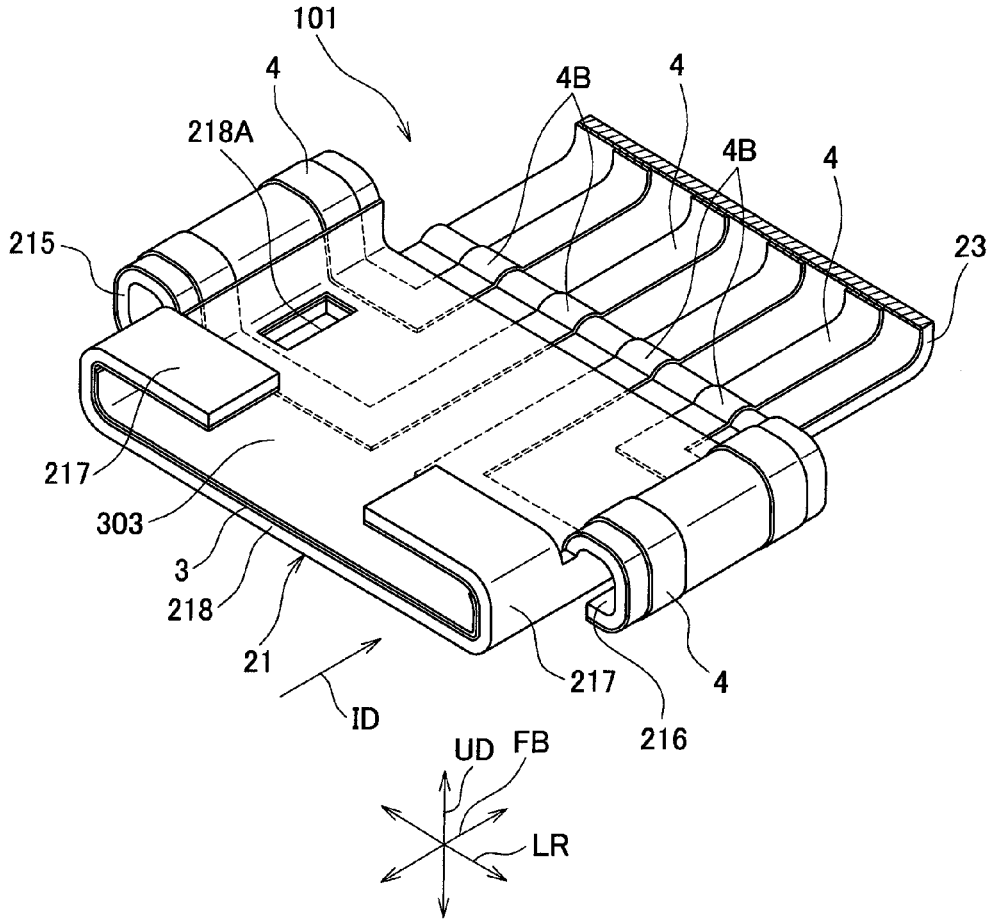
FIG. 12 is a perspective view of the connector shown in FIG. 10 in a state in which an upper part of a metal plate thereof is cut off.
Figure 13:
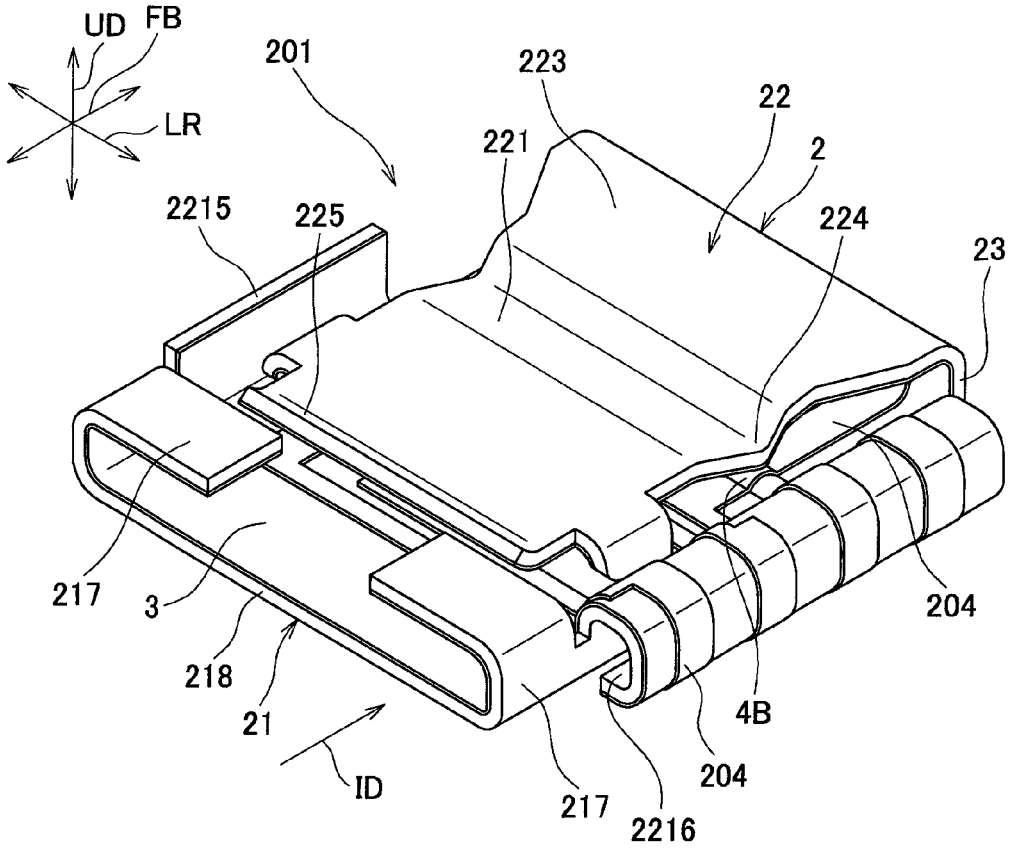
FIG. 13 is a perspective view of a connector according to a second variation of the embodiment.
Figure 14:
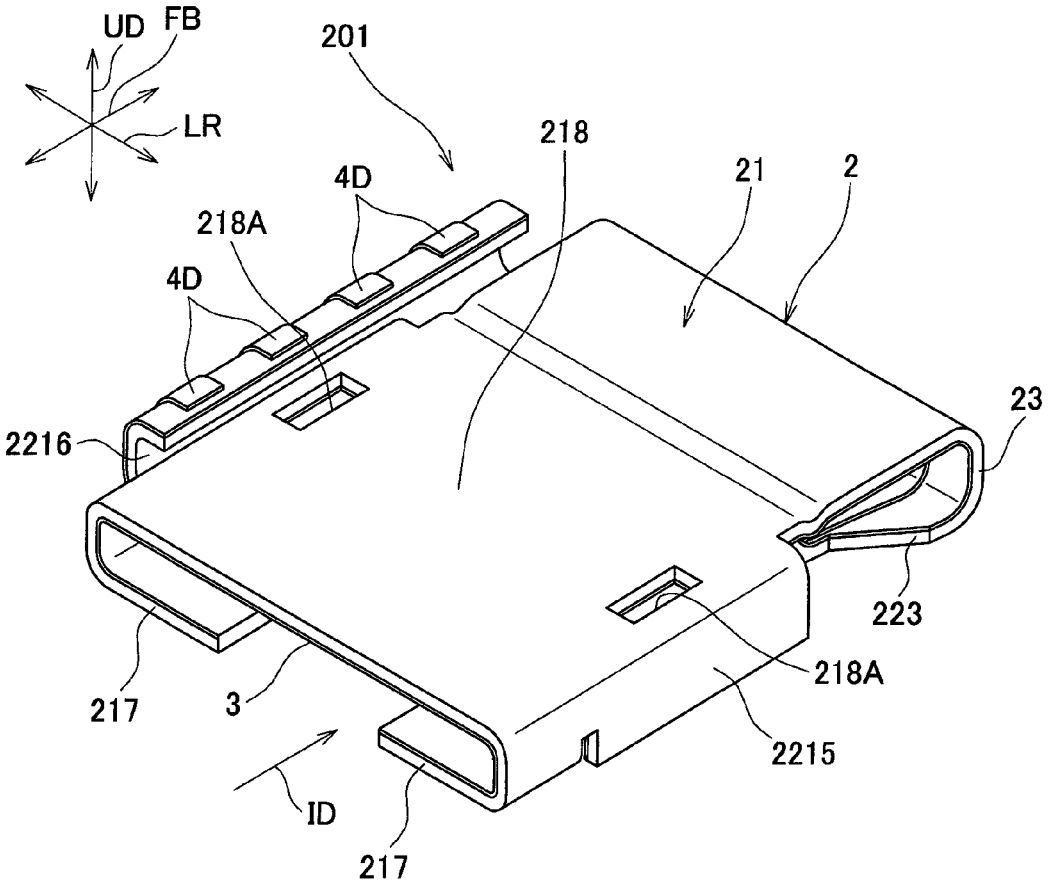
FIG. 14 is a perspective view of the connector shown in FIG. 13, as viewed obliquely from below.
Figure 15:
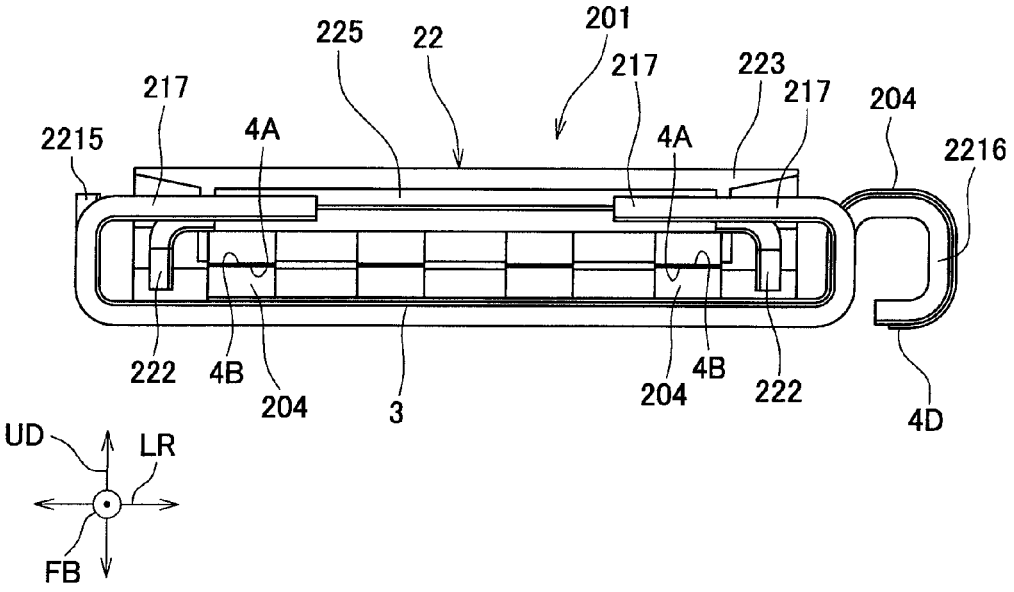
FIG. 15 is a front view of the connector shown in FIG. 13.
Figure 16:
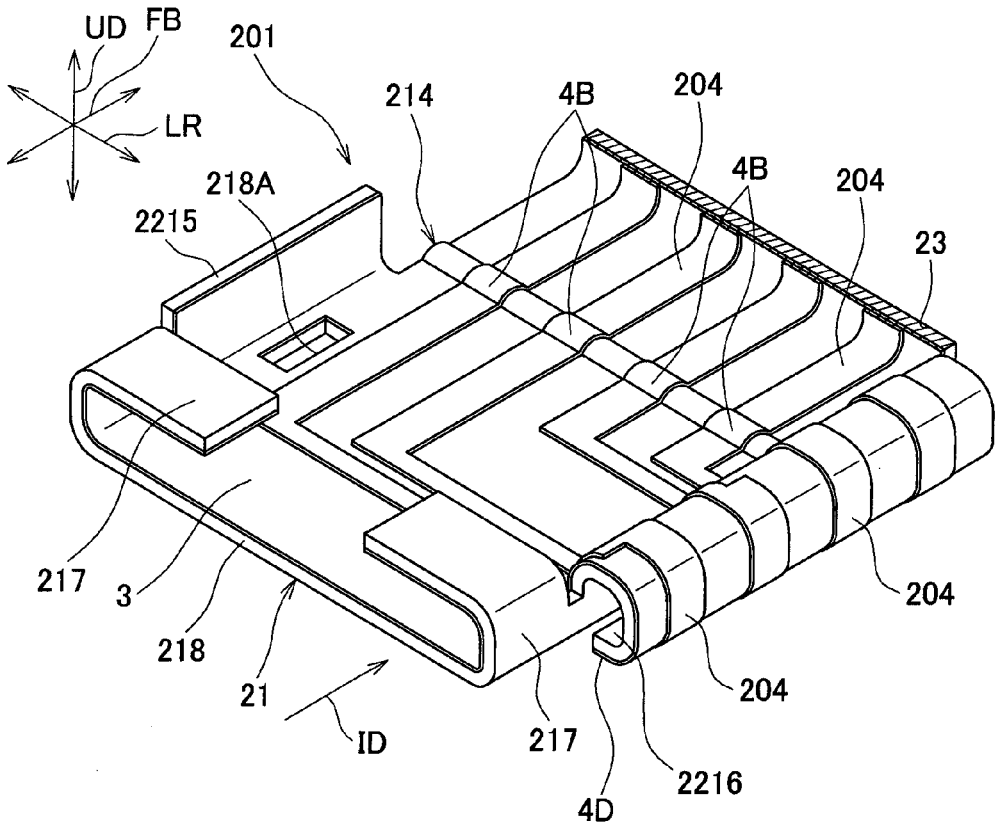
FIG. 16 is a perspective view of the connector shown in FIG. 13 in a state in which an upper part of a metal plate thereof is cut off, as viewed obliquely from above.

In the connector 101 according to the first variation, as shown in FIGS. 10 to 12, an insulating layer 303 covering the conductive path portions 4 is formed on part of the surface of the first supporting portion body 218 opposed to the second supporting portion 22, which is forward of the protruding portion 214 in the connector front-back direction FB, a side surface of the first protuberance portion 215 (side surface of the first protuberance portion 215 toward the first supporting portion body 218), and a side surface of the second protuberance portion 216 opposed to the side surface of the first protuberance portion 215 in the connector left-right direction LR (side surface of the second protuberance portion 216 toward the first supporting portion body 218).

According to the connector 101 of the first variation, it is possible to provide the same advantageous effects as provided by the embodiment shown in FIG. 1, and since the insulating layer 303 covers the conductive path portions 4 formed in predetermined areas of the first supporting portion body 218 and the like, as described above, even when the FPC 5 is inserted into the connector 101 by mistake when an electronic device (not shown) having the printed wiring board 6 is in a powered-on state, it is possible to prevent any of the conductive path portions 4 of the connector 101 from causing a short circuit between the terminal portions 5A of the FPC 5, and prevent any of the terminal portions 5A of the FPC 5 from causing a short circuit between the conductive path portions 4 of the connector 101. Further, it is possible to suppress insertion and removal of the FPC 5 into and from the connector 101 from causing damage to the conductive path portions 4.

Note that as for the areas where the insulating layer 303 is formed, the insulating layer 303 may be not formed in either of the side surface of the first protuberance portion 215 and the side surface of the second protuberance portion 216, but the insulating layer 303 may be formed in part of the surface of the first supporting portion body 218 opposed to the second supporting portion 22. This also makes it possible to suppress damage to the conductive path portions 4 formed on the surface of the first supporting portion body 218 opposed to the second supporting portion 22, and prevent a short circuit from being caused between the terminal portions 5A of the FPC 5 and between the conductive path portions 4 of the connector 101.

Next, a connector 201 according to a second variation of the present embodiment will be described with reference to FIGS. 13 to 18.

The same components as those of the connector according to the embodiment shown in FIG. 1 are denoted by the same reference numerals, and detailed description thereof is omitted. The following description will be given of only different components from those of the embodiment shown in FIG. 1.

Although in the embodiment shown in FIG. 1, the first protuberance portion 215 is provided at one end of the first supporting portion body 218 in the connector left-right direction LR, and the second protuberance portion 216 is provided at the other end of the first supporting portion body 218, in the connector 201 according to the second variation, as shown in FIGS. 13 to 18, a protuberance portion 2216 is provided only at one end of the first supporting portion body 218 in the connector left-right direction LR, and a side wall portion 2215 is provided at the other end of the first supporting portion body 218. The side wall portion 2215 suppresses displacement of the front end of the FPC 5 inserted into the connector 201 (displacement in the connector left-right direction LR).

The side wall portion 2215 and the side surface of the protuberance portion 2216 toward the first supporting portion body 218 are opposed to each other in the connector left-right direction LR.

Figure 18:
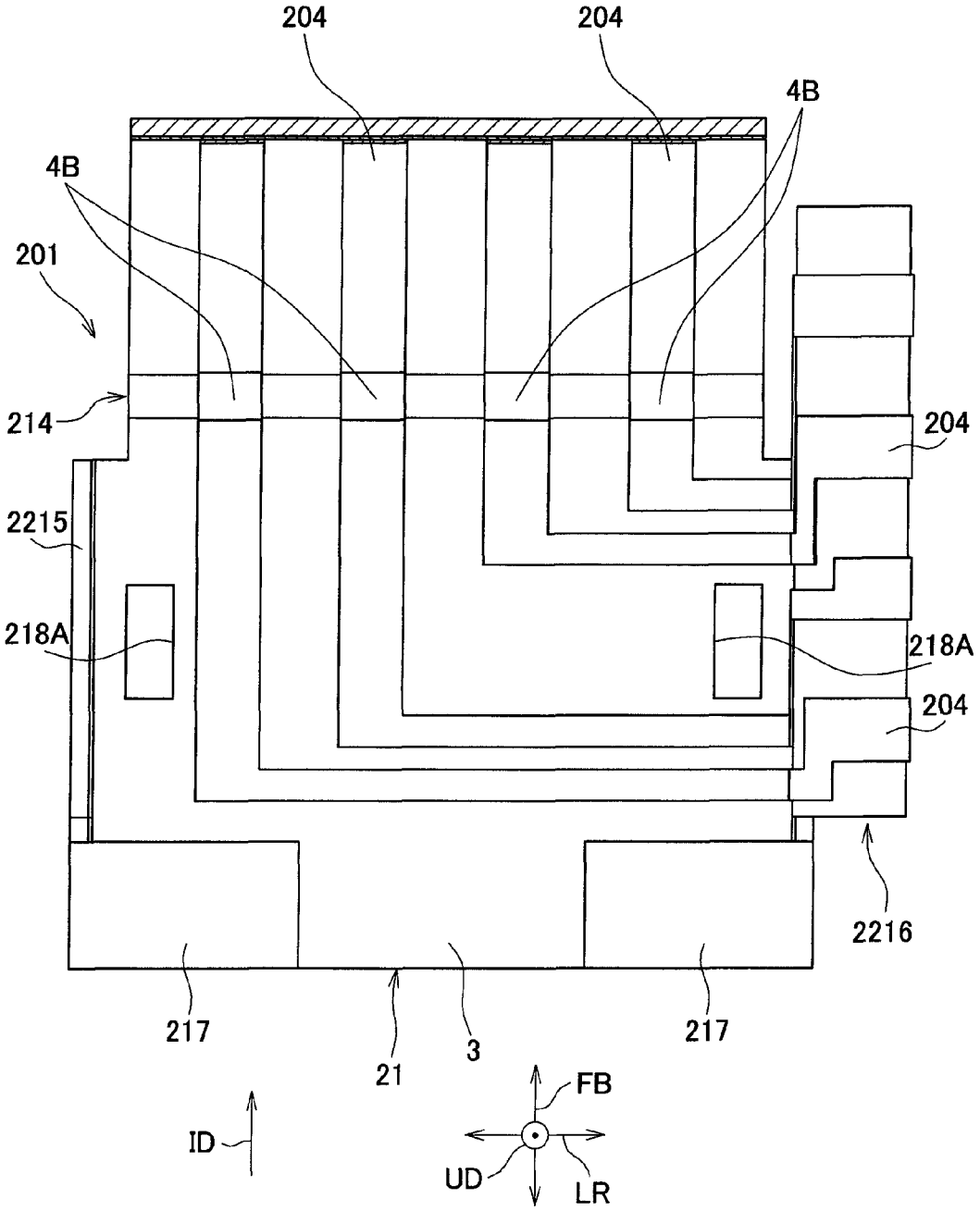
FIG. 18 is a plan view of the connector shown in FIG. 16.
Figure 19:
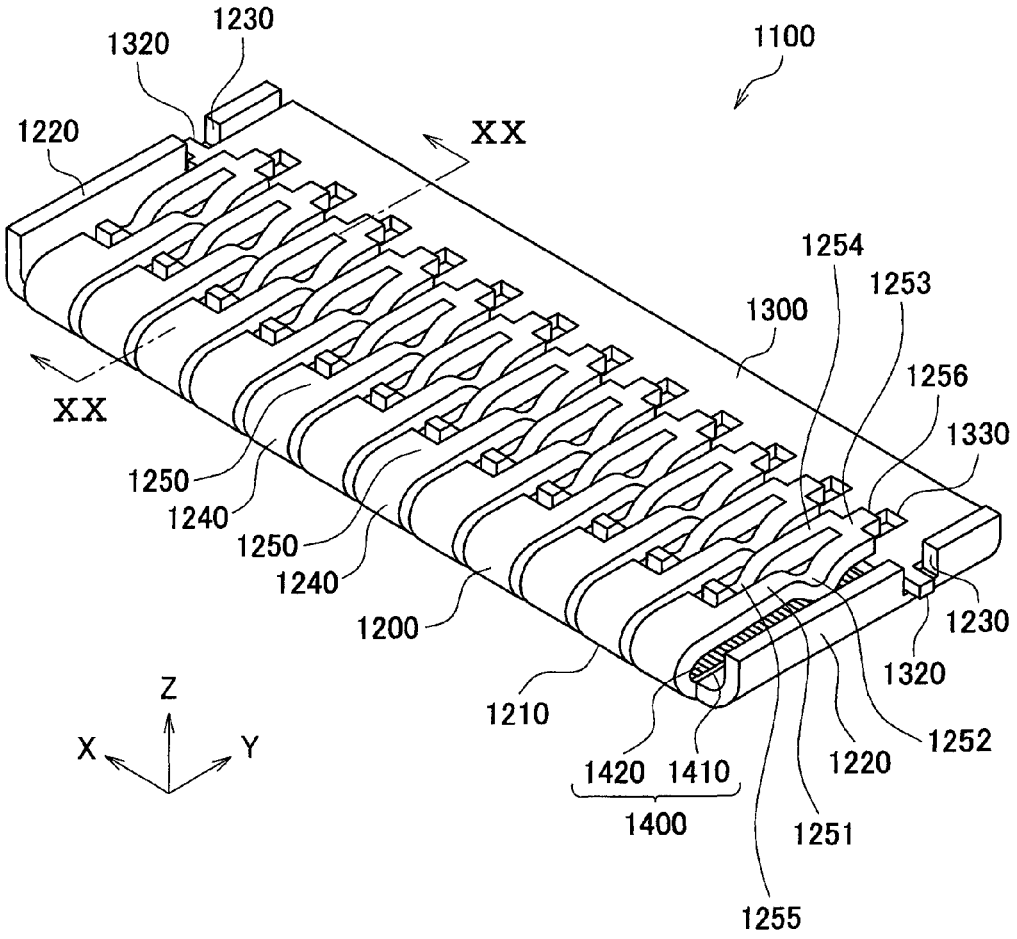
FIG. 19 is a perspective view of a conventional connector.
Figure 20:
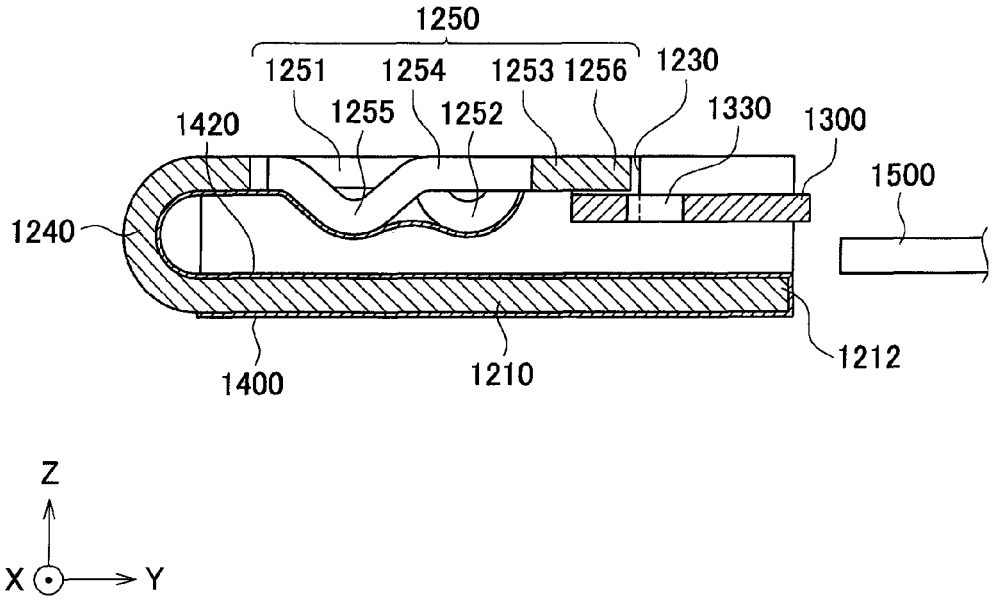
FIG. 20 is a cross-sectional view taken along XX-XX in FIG. 19.
Figure 21:
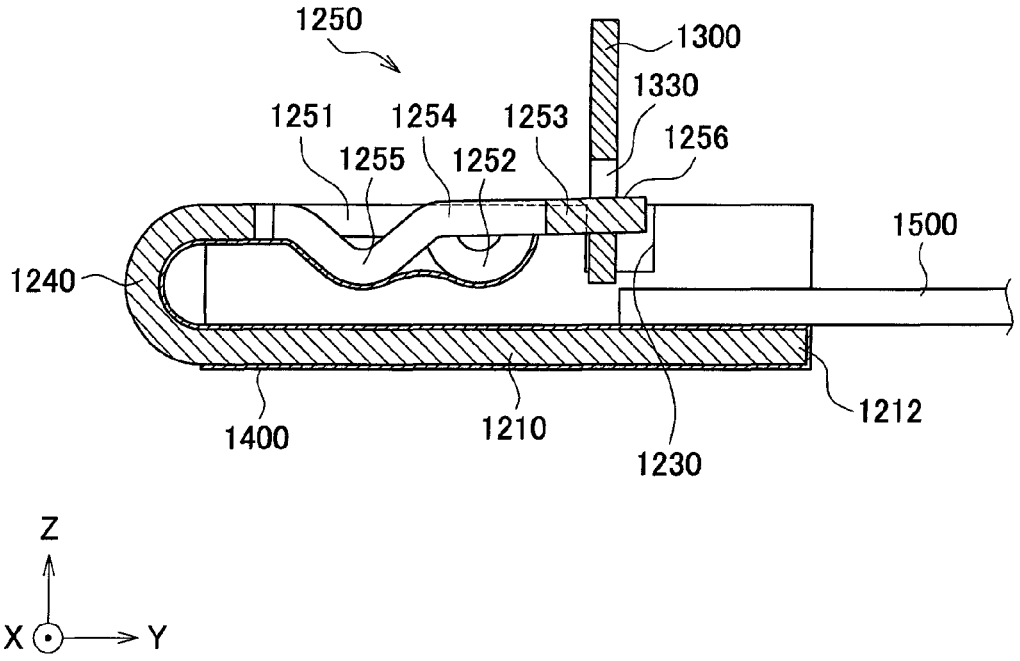
FIG. 21 is a cross-sectional view showing a state in which a object to be connected is being inserted into the connector shown in FIG. 19.
Figure 22:
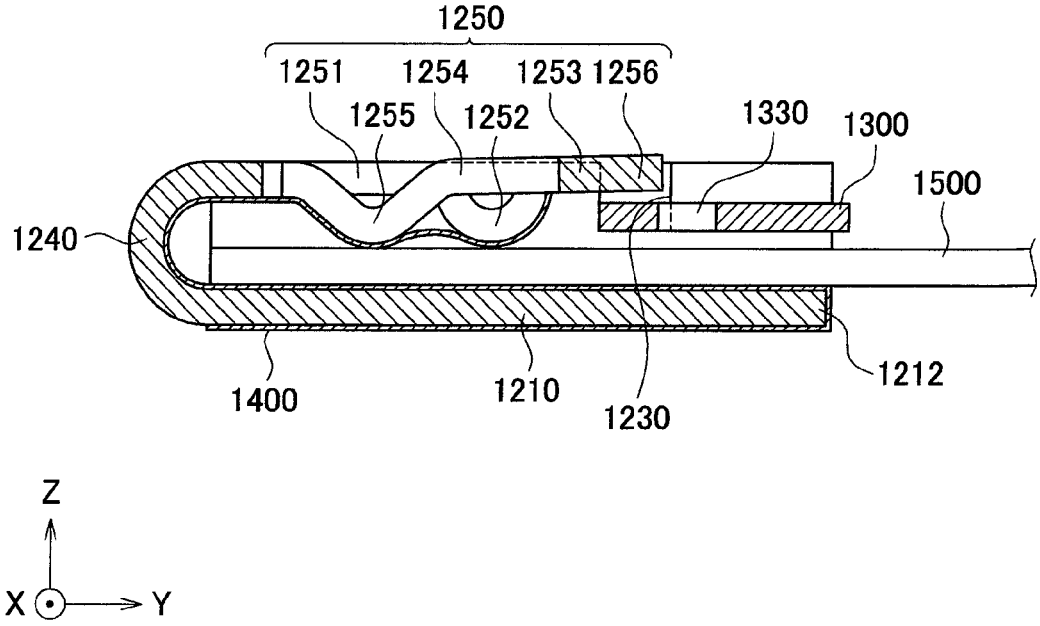
FIG. 22 is a cross-sectional view showing a state in which the object to be connected has been inserted into the connector shown in FIG. 19.

As shown in FIG. 18, the length of the protuberance portion 2216 in the connector front-back direction FB is substantially equal to the width of the first supporting portion body 218 in the connector left-right direction LR.

Figure 17:
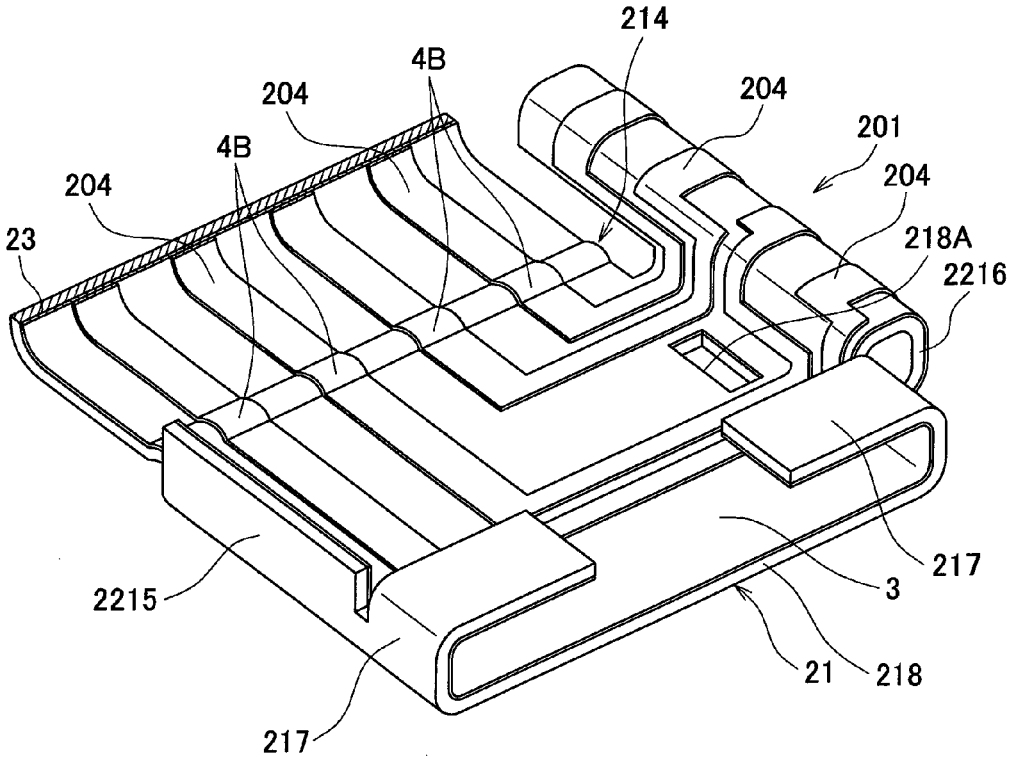
FIG. 17 is a perspective view of the connector shown in FIG. 13 in the state in which the upper part of the metal plate thereof is cut off, as viewed obliquely from above.

In the second variation, on the lower surface of the protuberance portion 2216 located at one end of the first supporting portion body 218 in the connector left-right direction LR, all connection portions 4D are arranged along the connector front-back direction FB. Further, as shown in FIGS. 17 and 18, the width of each conductive path portion 204 is not fixed, but part of the conductive path portion 204 (part between the contact point portion 4B and the connection portion 4D of the conductive path portion 204) is reduced in width. The length of the protuberance portion 2216 in the connector front-back direction FB is made substantially equal to the width of the first supporting portion body 218 in the connector left-right direction LR, whereby the arrangement pitch of the connection portions 4D is made substantially equal to the arrangement pitch of the contact point portions 4A and 4B.

According to the connector 201 of the second variation, it is possible to provide the same advantageous effects as provided by the embodiment shown in FIG. 1.

Although in the above-described embodiment and variations, the locking pieces 222 serve as both force application portions and locking portions, the force application portions and the locking portions may be divided. More specifically, for example, dedicated force application portions (not shown) for causing the movable portion 221 to move in the direction away from the first supporting portion 21, so as to increase the distance between the contact point portions 4A and 4B may be formed in a front-side portion of the connector in the front-rear direction (FB), and dedicated locking portions (not shown) for maintaining the state of the FPC 5 in which insertion thereof has been completed may be formed in a back-side portion of the connector in the front-back direction (FB), whereby the force application portions (not shown) and the locking portions (not shown) may be arranged in the front-back direction (FB) of the connector.

Further, although in the above-described embodiment and variations, the protruding portions 214 and 224 are formed on both the first supporting portion 21 and the second supporting portion 22, only the protruding portion 214 on the first supporting portions 21 may be formed, or only the protruding portion 224 on the second supporting portion 22 may be formed.

It is further understood by those skilled in the art that the foregoing are the preferred embodiments of the present invention, and that various changes and modification may be made thereto without departing from the spirit and scope thereof.

What is claimed is:

1. A connector that electrically connects a plate-shaped object to be connected and an other object to be connected to each other, comprising:

a metal plate for supporting the plate-shaped object to be connected in a sandwiching manner, said metal plate including a first supporting portion mounted on the other object to be connected, and a second supporting portion linked to said first supporting portion via a linking portion in a manner movable in a direction of sandwiching the plate-shaped object to be connected, said second supporting portion including:

a movable portion opposed to said first supporting portion, a spring portion for causing said movable portion to be urged against the plate-shaped object to be connected when the plate-shaped object to be connected is inserted between said first supporting portion and said movable portion, and a force application portion for causing said movable portion to move in a direction away from said first supporting portion to thereby increase a distance between said first supporting portion and said movable portion, when the plate-shaped object to be connected is inserted between said first supporting portion and said movable portion against a returning force of said spring portion, and for allowing said movable portion to move in a direction of approaching said first supporting portion by the returning force of the spring portion, when insertion of the plate-shaped object to be connected is completed; and a plurality of conductive path portions formed on said metal plate with an insulating layer provided therebetween, said plurality of conductive path portions respectively including contact point portions for being brought into contact with terminal portions of the plate-shaped object to be connected which is inserted between said first supporting portion and said movable portion, and connection portions for being connected to the other object to be connected, wherein at least one of said first supporting portion and said second supporting portion has a protruding portion formed thereon for pressing said contact point portions against the plate-shaped object to be connected which is inserted between said first supporting portion and said movable portion, wherein said contact point portions are arranged along an orthogonal direction to both of the direction of sandwiching the plate-shaped object to be connected and a connector front-back direction, and wherein said first supporting portion includes a first supporting portion body that is opposed to said second supporting portion in the direction of sandwiching the plate-shaped object to be connected, and is disposed on the other object to be connected, and a protuberance portion provided on said first supporting body and protruding outward of said force application portion in the orthogonal direction, and said connection portions are arranged on said protuberance portion along the connector front-back direction.

2. The connector according to claim 1, wherein said protuberance portion is provided as protuberance portions at respective opposite ends of said first supporting portion body in the orthogonal direction, wherein said connection portions of some of said plurality of conductive path portions are arranged on one of said protuberance portions along the connector front-back direction, and wherein said connection portions of the rest of said plurality of conductive path portions are arranged on the other of said protuberance portions along the connector front-back direction.

3. The connector according to claim 1, wherein said force application portion is located forward of said protruding portion in the connector front-back direction.

4. The connector according to claim 2, wherein said force application portion is located forward of said protruding portion in the connector front-back direction.

5. The connector according to claim 1, wherein said protuberance portion is bent into a hollow cylindrical shape such that said connection portions are brought into contact with the other plate-shaped object to be connected.

6. The connector according to claim 2, wherein said protuberance portion is bent into a hollow cylindrical shape such that said connection portions are brought into contact with the other plate-shaped object to be connected.

7. The connector according to claim 1, wherein said conductive path portions are covered with an insulating layer, at locations of part of a surface of said first supporting portion body opposed to said second supporting portion, said part being located forward of said protruding portion in the connector front-back direction.

8. The connector according to claim 2, wherein said conductive path portions are covered with an insulating layer, at locations of part of a surface of said first supporting portion body opposed to said second supporting portion, said part being located forward of said protruding portion in the connector front-back direction.

9. The connector according to claim 7, wherein said insulating layer covers said conductive path portions also at locations of a side surface of said protuberance portion toward said first supporting portion body.

10. The connector according to claim 8, wherein said insulating layer covers said conductive path portions also at locations of a side surface of said protuberance portion toward said first supporting portion body.

11. The connector according to claim 1, wherein said first supporting portion includes positioning portions provided at a front end of said first supporting portion body in the connector front-back direction, for suppressing displacement of the plate-shaped object to be connected in both of the direction of sandwiching the plate-shaped object to be connected and the orthogonal direction.

12. The connector according to claim 2, wherein said first supporting portion includes positioning portions provided at a front end of said first supporting portion body in the connector front-back direction, for suppressing displacement of the plate-shaped object to be connected in both of the direction of sandwiching the plate-shaped object to be connected and the orthogonal direction.

13. The connector according to claim 1, wherein said second supporting portion includes a locking portion for maintaining a state in which insertion of the plate-shaped object to be connected has been completed.

14. The connector according to claim 2, wherein said second supporting portion includes a locking portion for maintaining a state in which insertion of the plate-shaped object to be connected has been completed.

15. The connector according to claim 13, wherein said locking portion also serves as said force application portion.

16. The connector according to claim 14, wherein said locking portion also serves as said force application portion.

17. The connector according to claim 1, wherein said protruding portion is formed on each of said first supporting portion and said second supporting portion, and said protruding portion formed on said first supporting portion and said protruding portion formed on said second supporting portion are opposed to each other in the direction of sandwiching the plate-shaped object to be connected.

18. The connector according to claim 2, wherein said protruding portion is formed on each of said first supporting portion and said second supporting portion, and said protruding portion formed on said first supporting portion and said protruding portion formed on said second supporting portion are opposed to each other in the direction of sandwiching the plate-shaped object to be connected.

19. The connector according to claim 1, wherein said first supporting portion, said second supporting portion, and said linking portion are integrally formed with each other.

20. The connector according to claim 2, wherein said first supporting portion, said second supporting portion, and said linking portion are integrally formed with each other.

* * * * *